United States Patent [19]

Andersson

[11] Patent Number: 5,029,752

[45] Date of Patent: Jul. 9, 1991

[54] PACKAGE TO HOLD FLOWABLE CONTENTS AND WITH AN OPENING DEVICE

[75] Inventor: Par M. Andersson, St. Denis, Switzerland

[73] Assignee: Tetra Pak Holdings S.A., Pully, Switzerland

[21] Appl. No.: 575,126

[22] Filed: Aug. 30, 1990

[30] Foreign Application Priority Data

Sep. 5, 1989 [CH] Switzerland ..... 3217/89

[51] Int. Cl.[5] ..... B65D 5/54

[52] U.S. Cl. ..... 229/160.2; 206/605; 206/621.3; 206/628; 206/616

[58] Field of Search ..... 229/160.2; 206/621.1, 206/605, 615, 616, 621.2, 621.3, 624, 628

[56] References Cited

U.S. PATENT DOCUMENTS

| | | | |
|---|---|---|---|
| 2,546,052 | 3/1951 | Wilkins | 229/160.2 |
| 2,564,244 | 8/1951 | Bibler | 229/160.2 |
| 3,567,108 | 2/1969 | Corridon | 229/160.2 |
| 3,606,136 | 9/1971 | Hegardt | 229/160.2 |
| 4,787,507 | 11/1988 | Rausing | 229/160.2 |
| 4,913,294 | 4/1990 | Giacomelli | 229/160.2 |

*Primary Examiner*—Joseph Man-Fu Moy

*Attorney, Agent, or Firm*—Dann, Dorfman, Herrell & Skillman

[57] ABSTRACT

A package for milk is described which consists of a tube (1) forming the side walls (2, 3) and having a top (4) and a bottom of which the top (4) comprises at least one folded-over wall panel (5 to 8) constructed in one piece with the tube (1), an opening device (14) being provided within the top (4).

According to the invention, it is suggested that the pourer orifice be closed by a tab which can be torn open along a line of weakness (18) and which has an integrally moulded handle of synthetic plastics material, the line of weakness (18) extending as far as the outer edge (12) of the top (4) where it ends in or adjacent to a hole in the wall panel (5, 8) of the top (4) engaging around, connected to the handle, a cord (11) which projects inwardly from the surface of the top (4) which is towards the interior of the package, extending outwardly through the hole and being lengthened by the handle.

7 Claims, 4 Drawing Sheets

PACKAGE TO HOLD FLOWABLE CONTENTS AND WITH AN OPENING DEVICE

Figure 1:
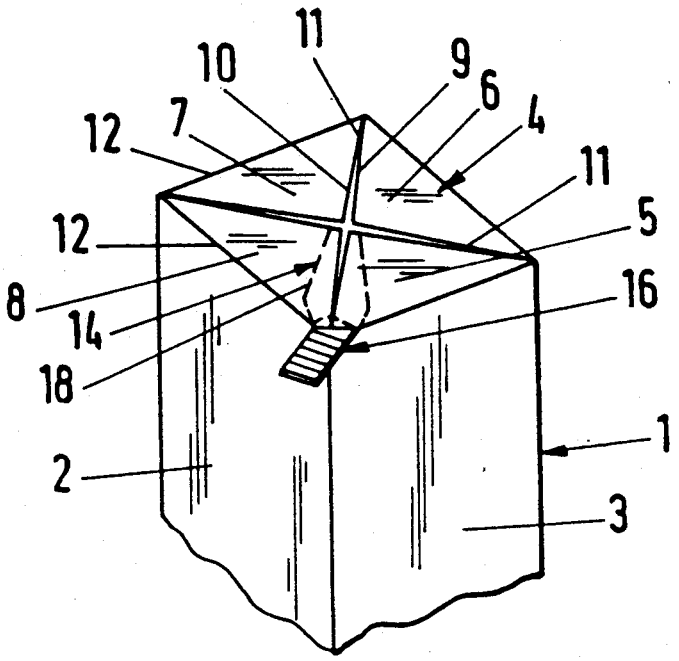

The invention relates to a package for flowable contents, particularly milk, juices or the like, and consisting of a tube forming the side walls, a top and a bottom, of which the top has at least one folded over wall panel constructed in one piece with the tube, an opening device being provided in the top.

A liquid package of known type has a top consisting of four such wall panels and in order to improve the aseptic properties, these are lined with a metal foil in order to achieve satisfactory gas-tightness. Disposed between the individual wall panels are narrow gaps because the prepared blank of the wall panels which consist of synthetic plastics coated carrier material consisting of paper, cardboard or the like, is so configured that the top surface is formed by the wall panels, narrow gaps being left closely adjacent one another. Rib-like bridges of synthetic plastics material are disposed in these narrow gaps and mask any cut edge of the carrier material so that the package is perfectly fluid-tight from the inside.

The prior art package has stamped out or cut out portions in the wall panels in which an opening device is also injection moulded along with the synthetic plastics bridges. Due to the injection moulding process using thermoplastics materials, it is possible to form variously constructed opening devices.

The use of thermoplastics materials however should be reduced in order on the one hand to render manufacture of the packages less expensive and on the other, if desired, in order to provide greater gas-tightness since it is well known that the gas barrier properties of thermoplastics materials are not the best. The man skilled in the art has therefore given thought to how the pourer orifice might be properly sealed in the region of an injection moulded opening device by means other than synthetic plastics membranes while at the same time being capable of being properly opened.

In the case of packages having a top end consisting of synthetic plastics coated paper, thoughts have also been given to disposing at a location, rivet-like, a web having a gripper means and provided on the outside of the top end, the pourer orifice being formed by pulling out a tear-open strip along a line of perforations provided in the top end. Where such an opening device is concerned, the line of perforations however extends along an oval or a circle and cannot be interrupted by a rib-like synthetic plastics bridge. Furthermore, the web of synthetic plastic material with the injection moulded rivet which extends through the top end, through a hole and into the interior of the package, and the gripper device are disposed outside of and above the top end of the package. A man skilled in the art will readily appreciate that specifically shaped tools and particular types of liquids packages are needed for the forming of such an opening device.

Therefore, the invention is based on the problem of so improving a package for flowable contents and of the type mentioned at the outset that it is possible to fit an opening device which can be satisfactorily operated and which is impervious to flowable media and which is also inexpensive for the producer when such a package is produced and marketed in large numbers.

According to the invention, this problem is resolved in that the pourer orifice of the opening device is closed by a tab which can be torn open along a line of weakness and which has an integrally moulded handle of synthetic plastic material, the line of weakness extending as far as the edge of the top member, where it finishes in or alongside a hole in the wall panel of the top member and engages around a cord connected to the handle and which projects inwardly from the surface of the top member which is towards the interior of the package, extending outwardly through the hole and being lengthened by the handle. It is true that as with the last described package, the synthetic plastics material also extends from the inside of the top member outwardly through a hole in the top member but the situation according to the invention is exactly reversed. According to the invention, the rib-like cord is in the surface of the top member which is towards the interior of the package and in fact it does protrude somewhat from this surface and towards the interior of the package, while the outer surface of the top member is virtually smooth and flat. From the foregoing teaching of the invention, a man skilled in the art will immediately appreciate the possibility of inexpensive manufacture if the rib-like web or cord provided in the interior of the package and consisting of synthetic plastic material is extended outwardly through the hole to the handle. Such an extension can be very cheaply formed. For the package producer, there is hardly any additional expense involved. For a mass-produced item this fact represents a significant advantage which will be seized upon by any man skilled in the art if moreover it offers favourable sealing-tightness and opening properties in the new opening device.

The tear-open tab which is indeed already known per se in other packages is according to the invention advantageously so connected to the synthetic plastics rib-like injection moulded cord that the line of weakness is initially provided in the carrier material which is then coated with synthetic plastics material to provide sealing-tightness. Therefore, it is sufficient for the carrier material to be weakened, the synthetic plastic coating on the outside being left undamaged. The integral moulding of the handle which can for example assume the form of a small tab with ribs, a thread or a loop, can according to the invention be carried out particularly cheaply because the handle outwardly constitutes an extension of the synthetic plastic cord which extends substantially within the package. The connection between the synthetic plastic cord on the inside and the handle on the outside is made through the hole in the top wall panel, which calls for particularly inexpensive tools for the injection moulding apparatus and for the package producer. But also the user acquires advantages when opening the previously satisfactorily fluids-tight opening device, because the line of weakness ends close to the hole so that the tearing process starts in the region of the hole and the tear-open tab which extends to a point adjacent the hole can then be torn up along the line of weakness. Together with the tear-open tab, also the rib-like synthetic plastics cord disposed within it is torn up, because the line of weakness engages around the synthetic plastic cord. Thus, the tearing open process is further facilitated because the end user only needs to initiate the tearing open process by applying a certain amount of force in the region of the hole. As the tearing open process continues, the tab lengthens along the line of weakness which is substantially provided only in the material of the wall panel, preferably in the paper which is coated on both sides with synthetic plastics material. It is well known that this can be torn through very easily.

According to the invention, it is furthermore favourable if the tear-open tab is articulated on the top member at the end opposite the tip of the spout. This measure facilitates re-closure, since the tear-open tab is held fast by the articulation on the top member even when the pourer orifice is open. To cover the pourer orifice when only a part of the contents has been removed, the end user only needs to pull the tab down again by pulling on the integrally moulded handle. The tab is automatically guided into its original position and can then be pressed in within the line of weakness.

In a further advantageous development of the invention, the top member is flat and consists of at least four triangular wall panels, the edges of the wall panels being connected to one another in fluid-tight manner by integrally moulded rib-like bridges of synthetic plastics material, the line of weakness being a line of perforations extending in two adjacent wall panels and which is disposed around both the hole and also around a rib-like bridge, the hole being stamped into at least one wall panel at its outer end. The measures according to the invention permit of ready stacking and re-packing of packages provided with the new opening device, because the top member is flat so that a plurality of packages can be placed one on top of another although rib-like synthetic plastic bridges extend in a cruciform pattern on the top member. According to the general teaching of the invention, therefore, on the inside of the package top the synthetic plastic cord is integrally moulded and passes over an unbroken part of or region of the top panel, a hole being provided at the edge of the tube, i.e. the fold line between the top wall panel and the side wall. The synthetic plastics material of the cord extends in the above-described manner through this hole out of the interior of the package outwardly and extends to the described handle. Furthermore, on both sides of the integrally moulded cord there is the line of weakness or perforations within the synthetic plastics coated paper, engaging around the aforementioned hole. In one alternative embodiment according to the invention, the synthetic plastics cord may extend from the tube edge and into the wall panel where it ends, preferably in the region of an anchoring hole in the paper at which the synthetic plastics cord is supported on the paper by a mushroom. This mushroom-shaped retaining stud is created in that a part of the synthetic plastics material extends outwardly from the interior of the package or passes outwardly through the anchoring aperture in the paper. The other embodiment is that in which the tear-open tab is moved to the corner of the top member and either is or is connected to a part of an integrally moulded rib-like synthetic plastic bridge.

Indeed, it is already known for a line of weakness to be constructed as a line of perforations and according to the invention preferably half the line of perforations extends in one wall panel of the top member while the other half extends in the adjacent wall panel of the top member, so that the rib-like synthetic plastics bridge can easily be enclosed in between, so that the aforementioned advantages can be enjoyed.

Furthermore, it is according to the invention expedient for the top member to be polygonal and for the hole to be stamped into the area of contact between two adjacent wall panels. The tube of the package described according to the invention may be of round, for example circular or oval cross-section but it may if necessary also be polygonal and preferably quadrangular or square. Blanks for such packages can be produced in a material-saving manner and the preparations for fitting the opening device according to the invention are incredibly simple and can be carried out with inexpensive and yet rugged tools, because only the edges of the wall panels and the hole need to be stamped between two adjacent wall panels. Furthermore, according to the invention, very small areas result which are only masked by synthetic plastics material, while the main areas of the package consist of the wall panels which, in the case of an aseptic package, can be of gas-impervious construction by the addition of metal foils.

According to the invention, it is also advantageous if the synthetic plastics material engages around the hole in at least one wall panel both outwardly and inwardly, like a mushroom. Where the pictorial representation of a mushroom is concerned, what is in mind here is the cross-section through the integrally moulded synthetic plastics material in the region of the hole. As in the case of a rivet, then, the synthetic plastics material engages around all the marginal areas of the hole, achieving not only an outstanding sealing-tightness in the case of liquids but also providing a possibility, in the case of a handle being integrally moulded onto the rivet-like synthetic plastics composition in the region of the hole, of providing a firm connection between the tear-open strip and the handle. When the opening process is initiated, therefore, the tearing-open force is guided accurately into the region of the hole and to the start of the line of weakness so that the tear-open tab is formed exactly in accordance with the envisaged outlines and can be opened without the need to implement any special actuating procedures. The end user only needs to grip the handle and pull up the tear-open tab. The pourer orifice is formed automatically and can in the manner described be even closed again, which is an advantage.

By the fact that the hole is stamped into the area of contact between two adjacent wall panels of a for example rectangular top member, the hole and also the tip of the pourer spout can be accurately disposed in one corner of the top member. The pouring process is defined particularly well with such an arrangement. No special pourer edge is needed because this is provided by the corner zone of the pourer orifice. The contents flow in a clearly defined stream over this corner. Furthermore, the new opening device is so constructed and simplified that if the pouring process is interrupted and the package is set down, no residues of contents remain clinging in corners or depressed areas of the opening device. These advantages favour the hygienic properties of the new opening device.

In the case of an expedient further development of the invention, the synthetic plastics cord connected to the handle ends within the edges of the wall panels of the top member and extends through an anchoring aperture disposed at a distance from the hole and outwardly from the interior of the package. Reference has already been made earlier to the two different embodiments, the one in which the synthetic plastics cord merges into the rib-like bridges between the edges of the wall panels of the top and the other, as described here, according to which the synthetic plastics cord has nothing to do with rib-like synthetic plastics bridges but is in addition disposed separately from these or on top members which do not have any such synthetic plastics bridges. In this case, there may for instance be a single wall panel within the edges of which the synthetic plastics cord ends if its starts at the top end of the tube. Or viewed from another direction: if the synthetic plastics cord starts in an area at the shortest distance from 1 to 4 and preferably 2 cm from the top member and around the anchoring aperture where it is injection moulded for example during manufacture, then it extends in the direction of the top member rim which coincides with the top edge of the tube, extending through the hole described and thus arriving at a connection to the outside of the package in which direction it extends to meet the handle. This embodiment which has no synthetic plastics bridges can be used universally and nevertheless makes it possible to achieve the same advantages as describer above in connection with the other alternative embodiments.

Figure 2:
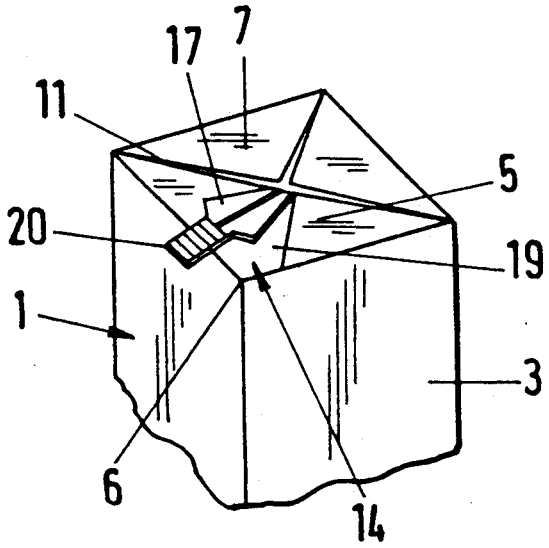
Figure 3:
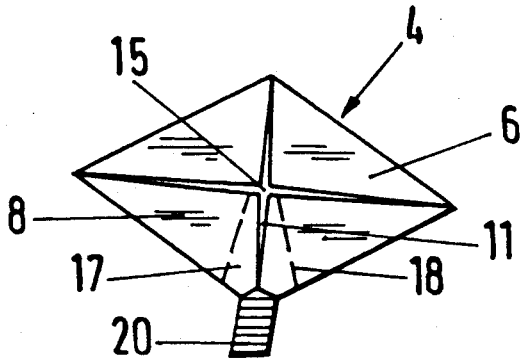
Figure 4:
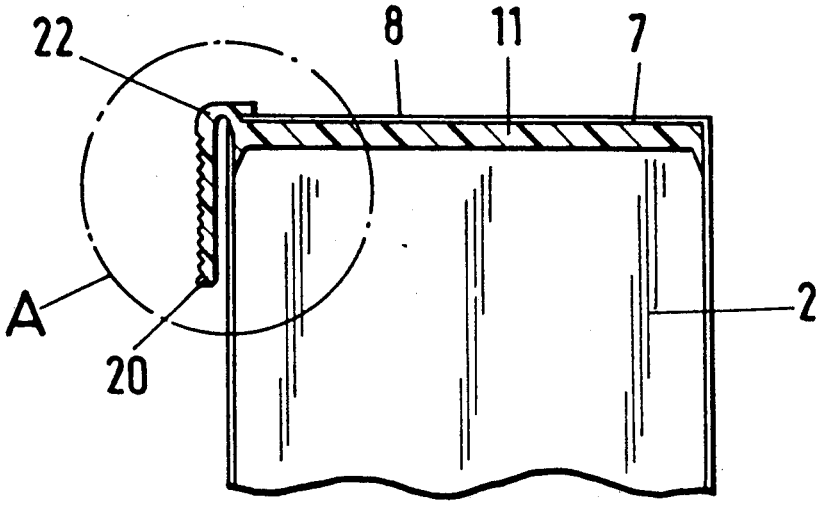
Figure 5:
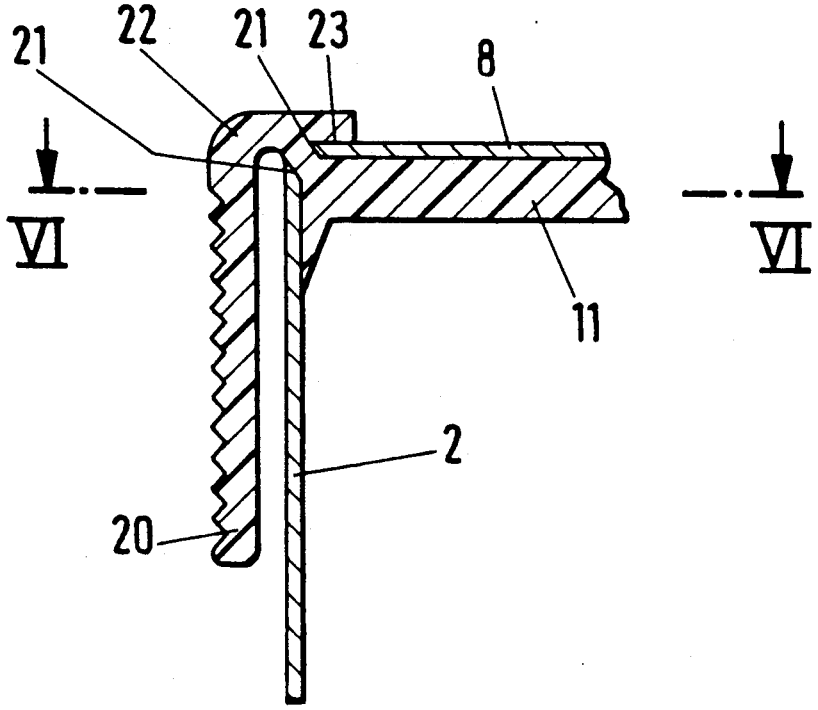
Figure 6:
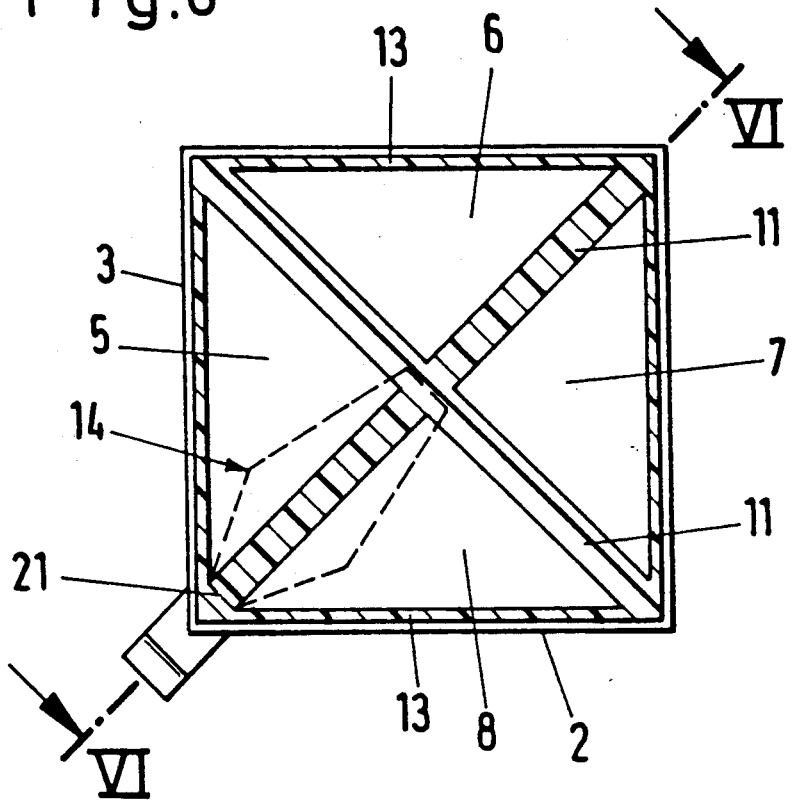
Figure 7:
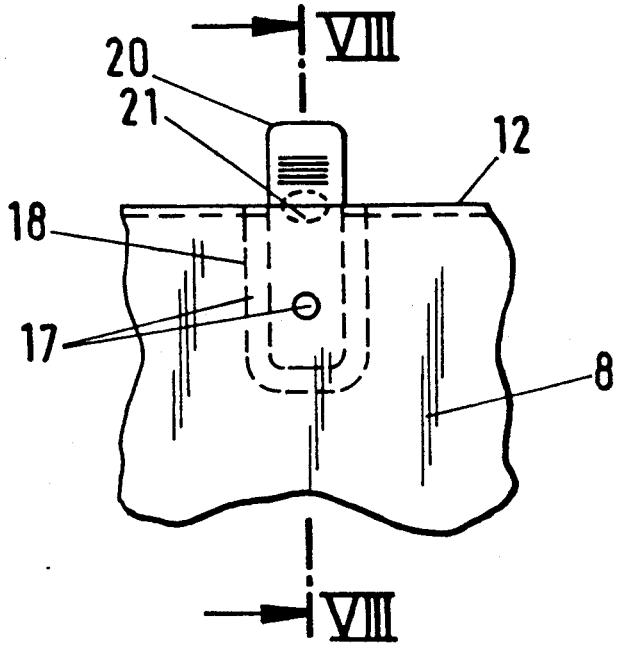
Figure 8:
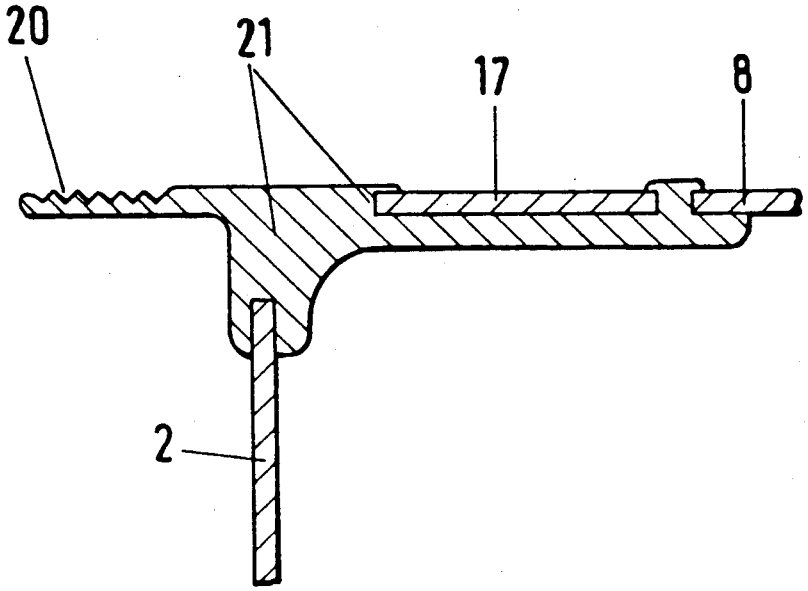
Figure 9:
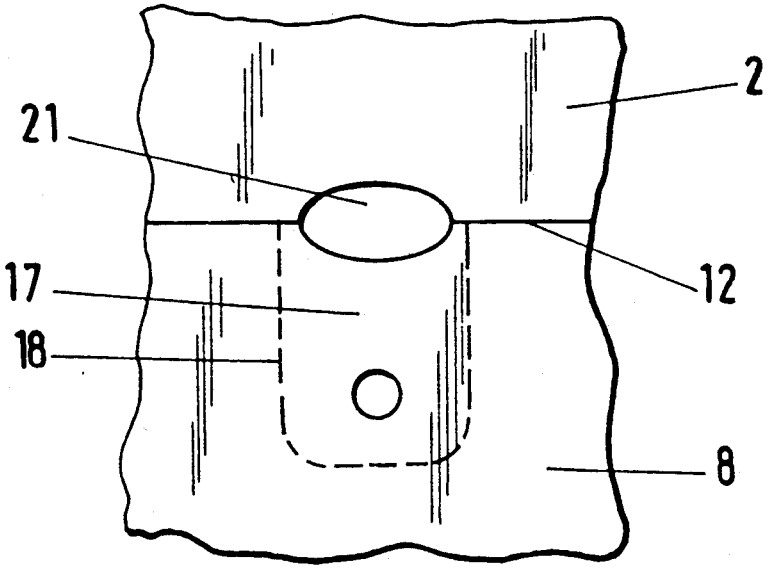

Further advantages, features and possible applications of the present invention will emerge from the ensuing description in conjunction with the appended drawings, in which:

FIG. 1 is a broken-away perspective plan view of a special embodiment of a liquids package with a flat top member and with the opening device in the closed state, FIG. 2 is a view similar to that in FIG. 1, the tear-open tab being however shown in the opened condition, FIG. 3 shows a plan view of the package according to FIG. 1, FIG. 4 is a cross-sectional view through the upper part of the tube of a package with a top member and an opening device, substantially on the line IV—IV in FIG. 6, FIG. 5 is a broken-away detail according to the dash-dotted circle A in FIG. 4, FIG. 6 shows a horizontal sectional view of the closed top member looking towards the interior of the package on line VI—VI of FIG. 4, FIG. 7 is a fragmentary plan view of the package according to another embodiment which differs from that in FIGS. 1 to 6 because this package has no synthetic plastics bridges and the opening device is not disposed in the corner of the top member, FIG. 8 is a cross-sectional view taken on the line VIII—VIII in FIG. 7 and FIG. 9 is a plan view of a part of the flat blank for the package prior to the integral moulding of synthetic plastics material, a side wall and the adjacent wall panel of the top member being opened up into a plane (the plane of the drawing) and broken away.

Of the various forms of package, FIGS. 1 to 6 show a package with a cross-sectionally quadrangular tube 1 with side walls 2 and 3. The other side walls are not shown here.

The bottom which is not shown here can likewise be formed by folded-over wall panels constructed in one piece with the tube 1 and forming two oppositely disposed double-walled triangular panels which are connected to the inside of the package. Such folded closures, also referred to as block bottoms, are known. The preferred embodiment of package shown here comprises a top member 4 consisting of four triangular wall panels 5, 6, 7 and 8.

Between the edges 9 and 10 of two for example pulled-out wall panels 6 and 7 and in the plane of the top member 4, there is a narrow gap closed by integrally moulded rib-like bridges 11. In a plan view, looking down onto the outer surface of the top member 4 as shown in FIGS. 1 to 3, only very narrow strips are shown. On the other hand, if one looks into the interior of the package, as can be seen in FIG. 6, then one can see the intersecting integrally moulded rib-like bridges 11 in a broad embodiment. Preferably, around and along the end edge 12 of the tube 1 at the top end there is, connecting the radially outer ends of the synthetic plastics bridges 11 in rectilinear pattern, a synthetic plastics web 13 which is preferably needed for the tools, but not in every case.

The opening device generally designated 14 extends from the centre 15 of the top member 4 towards the tip of the spout 16. In between there is a tear-open tab 17 which is pulled centrally and in a longitudinal direction by means of a rib-like synthetic plastics bridge 11. On the outside, the tear-open tab 17 (at a distance from the central synthetic plastics rib 11) is bounded by, constructed as a line of perforations, a line of weakness 18 which, after the tab 17 is pulled up as shown in FIG. 2 provides a pourer orifice 19. In the region of the pourer tip, i.e. outwardly, there is integrally moulded onto the rib-like synthetic plastics bridge 11 a handle 20 which in this case takes the form of a square tab with transverse ribs for a better grip.

The synthetic plastics material for the integrally moulded rib-like bridges 11 on the inside of the package and on the other hand of the handle 20 on the outside of the package consists of one piece and extends through a hole 21 disposed both in the wall panel 5 and also in the wall panel 8, for example half in each of them, in the top member 4. This synthetic plastics composition which extends from the inside outwardly through the hole 21 can be seen particularly clearly in FIGS. 4 and 5 and is identified by reference numeral 22. At the location 23 in FIG. 5 can be seen the mushroom-like engagement of this synthetic plastics composition 22 around the area of the hole 21.

For opening, the end user takes hold of the handle 20 which, as shown in FIGS. 4 and 5, may be bent downwardly on the edge between the side walls 2 and 3 or one of the side walls, bends it upwards into the position shown in FIG. 1 where the handle 20 lies substantially in the plane of the top member 4, its extension and initiates the tearing-open process at the tip of the spout 16. It will be evident that the synthetic plastics material 22 becomes detached from the side walls 2 and 3 because only a minimal area of adhesion is provided there, and the tear-open tab 17 in that the tear-open force makes it possible to tear through the line of weakness 18, whereas the rib-like synthetic plastics bridge 11 remains undisturbed. Tearing open takes place as far the end of the line of weakness 18 opposite the pourer 16, i.e. in the region of the centre 15 of the top member 4 where the tear-open tab 17 is articulated. Once the pourer orifice 19 has been exposed, therefore, the position shown in FIG. 2 is reached in which the tear-open tab 17 extends obliquely upwardly. The contents can now be poured out via the pourer tip 16. This is disposed at the edge of the hole 21 from which the synthetic plastics material 22 has been torn, together with the tear-open tab 17.

FIGS. 7 to 9 show another embodiment of an opening device on a package the top member of which does not have rib-like synthetic plastics bridges. Nevertheless, corresponding parts are primed by identical reference numerals to simplify reading and comprehension.

Assumed to be quadrangular, the tube again comprise a side wall 2' (only this is shown in this drawing), which merges via the end edge 12' of the tube into the wall panel 8' of the top member. It will be understood that according to the illustration in FIGS. 7 and 8, the plane of the side wall 2' is right-angles to that of the wall 8'. If one assumes a quadrangular tube, then the opening device 14' is disposed at any location between the corners of the top member and of course in the region of the top end edge 12' of the tube.

FIG. 7 shows a broken-away a view of the alternative embodiment of liquids package described here, the view being towards the wall panel 8'. The tear-open tab 17' is defined by the line of weakness 18' which is constructed as a line of perforations and which starting from the end edge 12' of the tube extends in a U-shape around the synthetic plastics composition 22'. In this embodiment, the synthetic plastic composition 22' of the integrally moulded bridging element or plug device 14' cord is shown in FIG. 8 disposed partially on the inside of the package and on the other hand it again forms the handle 20' on the outside of the package. The synthetic plastics composition 22' consists of one piece and extends in the same way as with the above-described other embodiment through the hole 21' in the coated paper and in fact in the region of the top end edge 12' of the tube between the side wall 2' and the wall panel 8' of the top member. The synthetic plastics composition 22' of the bridging element also engages in mushroom fashion around the hole 21'.

Because the plug-like synthetic plastics composition 22' does not extend into a rib-like bridge between panels and is not provided in the embodiment shown here in FIGS. 7 to 9, the synthetic plastics composition 22' ends at 27' on the inner side opposite the handle 20' about 2 to 3 cm from the upper end edge 12' of the tube, as shown in FIG. 7 by the broken line. To someone looking at the completely closed package in the direction shown in FIG. 7, this is just as difficult to see as the hole 21' which is also indicated as a broken line in FIG. 7. But the observer does see an anchoring stud 25' in the region of which the synthetic plastics composition 22' of the element 14' extends outwards from the interior of the package through an anchoring aperture 26' (see FIG. 9). In FIG. 8, the cross-section of this anchoring stud 25' is shown as a mushroom shape, an embodiment which is preferred in practice.

In the view shown in FIG. 7, the user possibly sees the line of weakness 18' even in the closed state of the package. After a single use, this line 18' has been torn open and this is readily obvious to the viewer. It is engaged around the tear-open tab 17'.

FIG. 9 shows in plan view the paper panels 2' and 8' which have been worked on, together with the hole 21' provided in both and in the vicinity of which the U-shaped line of perforations 18' ends. It is also possible to see the anchoring aperture 26' which is, for example, a circular hole.

In the base 27 which connects the two free arms of the U of the line of weakness 18, the line of perforations or weakness 18 may be interrupted to produce an articulation for the tear-open tab 17.

In use, the end user grips the handle 20' and tears it upwards in the direction of the centre of the top member. The synthetic plastics composition 22' of the element becomes detached from the paper in the region of the hole 21' but remains attached to the paper of the tear-open tab 17' within the broken line 27' in FIG. 7 so that the line of weakness 18' is torn open until the opening device is fully opened.

What is claimed is:

1. A package for flowable contents, particularly mild, juices or the like, and consisting of a tube forming the side walls, a top and a bottom joined to the side walls, of which the top has at least one folded over wall panel constructed in one piece with the tube, a pourer orifice formed adjacent the function of the top with the side walls, and an opening device provided in the top, said top comprising a line of weakness defining a tab which can be torn open alon said line of weakness, and an integrally moulded handle of synthetic plastics material disposed outside said package, the line of weakness extending as far as the edge of the top where it terminates adjacent said pourer orifice, and a bridging element connected to the handle and projecting inwardly through said orifice beyond the under surface of the top member to close the orifice, and extending along the tab within said line of weakness, whereby pulling said handle toward the center of the top along said line of weakness causes said bridging element to open the orifice and tear said tab out of said top along said line of weakness.

2. A package according to claim 1, characterised in that said tab is articulated on the top at an end opposite the pourer orifice.

3. A package according to claim 1, wherein the top is flat and is formed by at least four triangular panels, the edges of the panels being connected to one another in fluid-tight manner by integrally moulded rib-like bridges of synthetic plastics material in the interior of the package, one of said bridges comprising said bridging element, and the line of weakness is a line of perforations extending in two adjacent panels and which is disposed around both the pourer orifice and also said one rib-like bridge, and at the outer end of which the hole said orifice comprising a hole stamped into at least one wall panel at an outer end of said line.

4. A package according to claim 1 wherein the top is polygonal and said orifice comprises a hole stamped into the area of the junction between two adjacent panels and the side walls.

5. A package according to claim 1, wherein said bridging element at said orifice is comprised of synthetic plastics material which sealingly engages at least one panel outwardly and inwardly in the manner of a mushroom.

6. A package according to claim 1, wherein said bridging element is comprised of synthetic plastics material connected to the handle and terminates at one end within the edges of the panels of the top member (4), said top comprising an anchoring aperture in said tab disposed at a distance from said orifice, said bridging element having material extending through said aperture.

7. A package according to claim 6 wherein said bridging element sealingly engages said orifice and said anchoring aperture, engaging the panel outwardly and inwardly in the manner of a mushroom.

* * * * *

UNITED STATES PATENT AND TRADEMARK OFFICE

CERTIFICATE OF CORRECTION

PATENT NO. : 5,029,752

DATED : July 9, 1991

INVENTOR(S) : Par M. Andersson

It is certified that error appears in the above-identified patent and that said Letters Patent is hereby corrected as shown below:

Column 5, line 15, "describer" should be --described--;

Column 6, line 62, "primed" should be --identified--;

line 62, "identical" should be --primed--;

Column 7, line 27, after "between" insert --wall--;

Column 8, line 4, "mild" should be --milk--;

Column 8, line 12, "alon" should be --along--.

Signed and Sealed this

Twenty-fourth Day of November, 1992

*Attest:*

DOUGLAS B. COMER

*Attesting Officer*

*Acting Commissioner of Patents and Trademarks*